US009221665B1

(12) United States Patent
Adamczak

(10) Patent No.: US 9,221,665 B1
(45) Date of Patent: Dec. 29, 2015

(54) MANUAL LEFT OR RIGHT HAND CAN OPENER WITH TILT AND ROTATING SPHERICAL JOINT

(71) Applicant: Gregory Mark Adamczak, Stamford, CT (US)

(72) Inventor: Gregory Mark Adamczak, Stamford, CT (US)

( * ) Notice: Subject to any disclaimer, the term of this patent is extended or adjusted under 35 U.S.C. 154(b) by 0 days.

(21) Appl. No.: 14/558,098

(22) Filed: Dec. 2, 2014

Related U.S. Application Data

(60) Provisional application No. 61/912,347, filed on Dec. 5, 2013.

(51) Int. Cl.
*B67B 7/00* (2006.01)
*B67B 7/46* (2006.01)

(52) U.S. Cl.
CPC ..... *B67B 7/34* (2013.01)

(58) Field of Classification Search
CPC ..... B67B 7/30; B67B 7/32; B67B 7/34; B67B 7/38; B67B 7/385; B67B 2007/303
USPC ..... 30/409, 410, 416, 420–427, 431; D8/40–43
See application file for complete search history.

(56) References Cited

U.S. PATENT DOCUMENTS

| | | | | | |
|---|---|---|---|---|---|
| 2,474,982 | A | * | 7/1949 | McLean | 30/420 |
| 2,563,569 | A | * | 8/1951 | Walton | 30/422 |
| 2,565,048 | A | * | 8/1951 | Rush | 30/422 |
| 2,565,144 | A | * | 8/1951 | McLean | 30/420 |
| 2,592,933 | A | * | 4/1952 | McLean | 30/420 |
| 2,592,937 | A | * | 4/1952 | McLean | 30/422 |
| 2,675,611 | A | * | 4/1954 | Moore | 30/422 |
| 2,810,952 | A | * | 10/1957 | Sundell | 30/425 |
| 3,002,275 | A | * | 10/1961 | Edlund | 30/422 |
| 3,059,333 | A | * | 10/1962 | Landry | 30/409 |
| 3,075,285 | A | * | 1/1963 | Desjardin et al. | 30/421 |
| 3,321,830 | A | * | 5/1967 | McLean | 30/422 |
| 3,594,901 | A | * | 7/1971 | Van Der Kroft | 30/422 |
| 3,624,680 | A | * | 11/1971 | Evans | 30/435 |
| 3,706,135 | A | * | 12/1972 | Fukunaga et al. | 30/421 |
| 3,740,840 | A | * | 6/1973 | McLaren et al. | 30/417 |
| 3,765,085 | A | * | 10/1973 | Ponczek et al. | 30/421 |
| 3,808,917 | A | * | 5/1974 | McLaren et al. | 82/47 |
| 3,837,075 | A | * | 9/1974 | Yamamoto | 30/404 |
| 4,053,981 | A | * | 10/1977 | Aberer | 30/426 |
| 4,574,482 | A | * | 3/1986 | van der Wouden | 30/426 |
| 4,922,617 | A | * | 5/1990 | Kurz | 30/421 |
| 5,170,565 | A | * | 12/1992 | Brisard | 30/421 |
| 5,291,658 | A | * | 3/1994 | Wilson et al. | 30/422 |
| 5,421,092 | A | * | 6/1995 | Guilmette et al. | 30/416 |
| 5,666,735 | A | * | 9/1997 | Kosten et al. | 30/416 |
| 6,119,352 | A | * | 9/2000 | Adamczak | 30/422 |
| 6,249,980 | B1 | * | 6/2001 | Edwards | 30/416 |
| D520,826 | S | * | 5/2006 | Parlowski | D8/41 |
| D555,448 | S | * | 11/2007 | Sanders et al. | D8/41 |
| D555,998 | S | * | 11/2007 | Mah et al. | D8/41 |

(Continued)

*Primary Examiner* — Jason Daniel Prone
(74) *Attorney, Agent, or Firm* — Hess Patent Law Firm LLC; Robert J. Hess

(57) ABSTRACT

A manual can opener that can be operated with ease by both left-handed and right-handed users. The initial rotation of an operating handle in either direction moves readily a cutting blade toward a transport wheel to engage the lid of the can, and simultaneously rotates the transport wheel in a direction opposite to that of handle rotation so that the cutting blade is in proper condition to cut a lid from the can. Further rotation of the operating handle, in the direction of initial rotation, then forces the can against the blade to cut the lid of the can.

14 Claims, 6 Drawing Sheets

(56) References Cited

U.S. PATENT DOCUMENTS

D572,098 S * 7/2008 Hui ..... D8/41
D594,301 S * 6/2009 Mah et al. ..... D8/41
D624,377 S * 9/2010 Mah et al. ..... D8/40
D643,268 S * 8/2011 Mah et al. ..... D8/41
8,371,033 B2 * 2/2013 Cantore et al. ..... 30/425

* cited by examiner

MANUAL LEFT OR RIGHT HAND CAN OPENER WITH TILT AND ROTATING SPHERICAL JOINT

FIELD OF THE INVENTION

The present invention relates generally to can opener. Specifically, the present invention relates to a manually operated can opener that can be operated equally as well by left or right-handed users. The can opener of the present invention allows one to select direction in which the operating handle is tern. Such selection allows the user to operate readily the can opener with either hand.

BACKGROUND OF INVENTION

In general, manual can openers employ components inclusive of a rotary transport wheel and a cutting blade. Each component is arranged on separate elements of a hinged frame. In operation, the transport wheel engages the rim of a can. The frame elements are brought together to move cutting blade into the contact with the top end of the can with such pressure that the can top is pierced or pressured by cutting blade. A handle, which is attached to the rotary transport wheel, is then turned by the user's fingers supported by palm of the hand, and turn to rotate the can into the blade and, thus, cut the can top and thus form a cut lid.

With such can operators, an operating handle is provided only on one side of the transport wheel. Accordingly, when the transport wheel positions the can for cutting, the blade is capable of cutting only in one direction. Since the majority of people are right handled, such manually operated can openers have been configured so that the handle is turned readily with one's right hand. Obviously, such can openers are difficult to use with a left hand. Can openers can be made to be operated by a left hand or left-handed person. However, such left-handed operable can openers provide the same difficulty to a right-handed person that conventional can openers provide to a left-handed person.

Moreover, conventional can openers require users to turn the handle with their fingers. Such can openers are difficult or impassible to use for users who have limited motion in their fingers. These include elderly users, users with arthritis, or generally users with motor ailments that limit the use of their fingers and the palm of hand.

To overcame this problem, can openers can be operated with either hand and have been created, such as disclosed by commonly owned U.S. Pat. No. 6,1119,352, the contents of which are incorporated herein, by users who lock the full dexterity of their fingers and the hand palm.

Accordingly, there is a need for an improved can opener. There is also a need for a manually operated can opener that can be operated easily by either the left or right hand supported by the palm users who lack the full dexterity of fingers.

SUMMARY OF THE INVENTION

It is an object of the present invention to provide a manually operated can opener that can be selectively operated with either the right or left hand of the users who lack the full dexterity of fingers and the hand palm.

It is another object of the present invention to provide such a can opener in which the operating handle can be selected, as desired, to rotate in clockwise and counterclockwise directions.

It further object of the invention to provide such a can opener in which the rotation of the operating handle, in either direction, automatically moves the cutting blade and the transport wheel into proper position to cut the can top.

These and other objects of the present invention are provided by a manual left or right hand can opener with a tilt and rotating spherical joint. In one embodiment of the present invention, a can opener is provided to have a housing, a driver connected to the housing and having a transport wheel at one end, a handle, a shaft connected to the handle at one end and to the driver at another end, a blade holder connected to the selector at one end and to a cutting blade at another end, and a helical cam connected to the handle and mounted for rotation with the driver.

In another embodiment of the present invention, the can opener has a housing, a driver connected to said housing, said driver including a first sphere, a shaft connected via a second sphere to said driver and adapted to tilt and rotate with said driver, a transport wheel connected to said driver and rotatable with drive shaft, a cutting blade connected to a blade holder, and a selector operatively connecting a cam and said driver such that said driver rotates selectively in one of the first direction and a second direction to cut the lid from the can, wherein the blade holder has spherical surface adapted to be in spherical connection with spherical part of to said driver.

Initial rotation of the handle moves the transport wheel and the cutting blade into engagement with the can. Further rotation of the handle forces the can against the cutting blade to cut the end, such as a top or lid, from the can.

DETAILED DESCRIPTION OF THE INVENTION

Exemplary embodiments of the present invention may be further understood with reference of the following description and related appended drawings.

Figure 2:
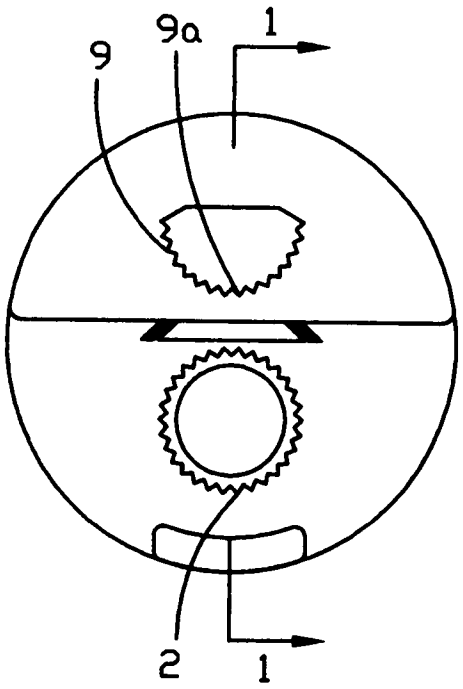
FIG. 2 is a front view of the can opener of FIG. 1.
Figure 1:
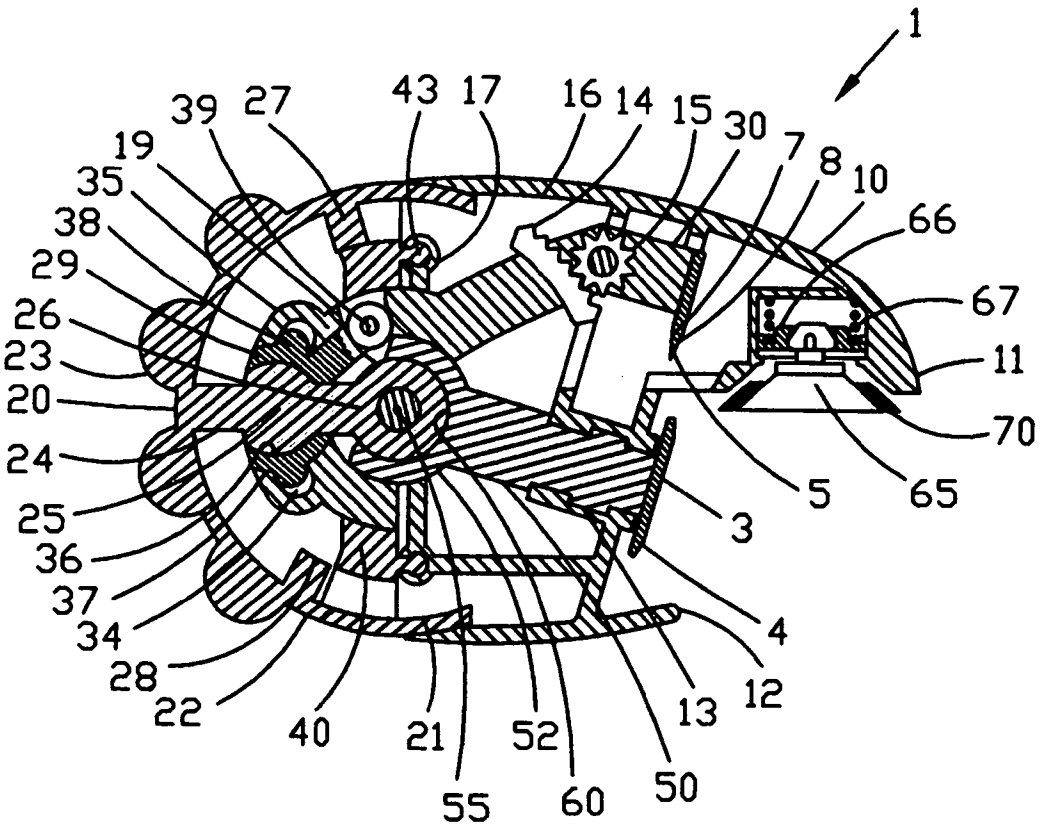
FIG. 1 is a sectional view of an exemplary embodiment of the can opener of the present invention.
Figure 4:
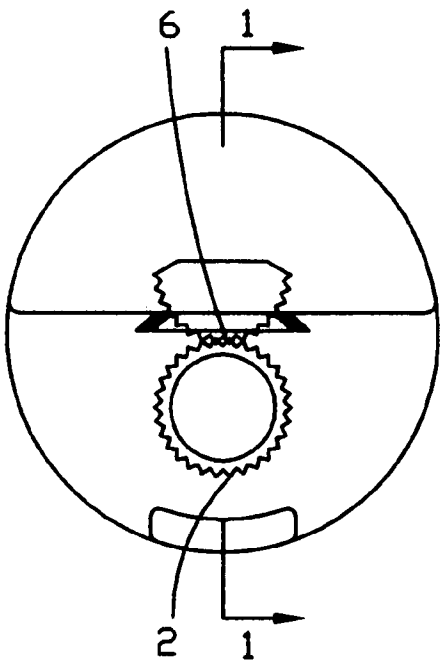
FIG. 4 is a front view of the can opener FIG. 1, but with the can removed to better show the position of the cutting blade and the transport wheel of the can opener.

Referring to the figure and FIG. 1, a manually operated can opener 1 is provided. Can opener 1 includes a housing 10 and a handle 20.

The housing 10 is at one end of can opener 1 and has an oval shape. The housing 10 includes a hood 11, side walls 16 and, flange 17, bearing 13, segment of a spur gear 14, and can guide 12.

A handle 20 is positioned at the other end of can opener 1 and has at least a partially spherical shape. The handle 20 includes an inner handle surface 21 and outer handle surface 22, with a guide selector 24 protruding inward from the center of inner handle surface 21 to engage with the selector 29. The inner and outer handle surfaces 21, 22 are partial spherical surfaces. Handle 20 further includes a set of cam followers 27, 28 configured with to engage with a cam 40. The handle 20 also includes partial spherical protrusions 23 on its outer handle surface 22. The partial spherical protrusions 23 allow a better grip on the handle 20 with limited use of fingers and palm.

Figure 7:
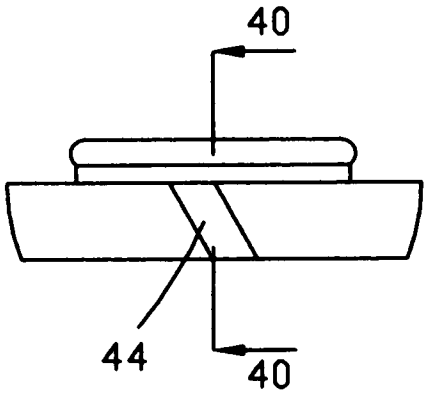
FIG. 7 is a front view of cam with right hand helical path of the cam.
Figure 8:
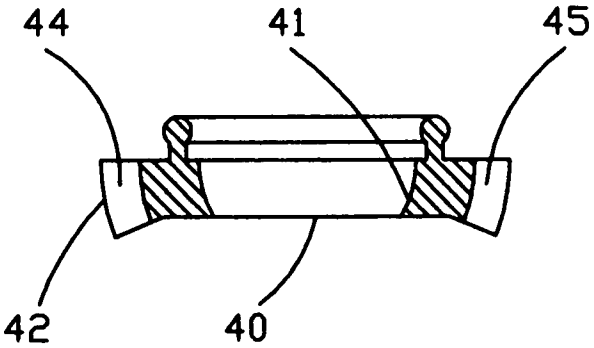
FIG. 8 is sectional view of FIG. 7.
Figure 9:
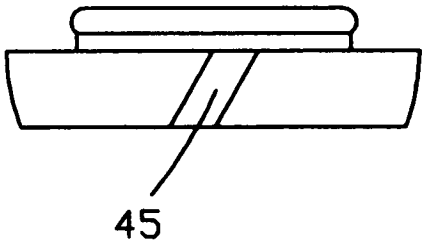
FIG. 9 is a mirror view of FIG. 7 to show left hand helical path of the cam.

As shown in FIGS. 7-9, the cam 40 has an inner cam surface 41, and an outer cam surface 42. The inner and outer cam surfaces 41, 42 are partial spherical surfaces. The cam 40 has a first helical cam path 44 (right-hand mode) and a second helical path 45 (left-hand mode). Referring back to FIG. 1, the cam 40 is mounted for rotation in groove 43 in the flange 17 of the housing 10. The cam 40 is further mounted concentrically for rotation with a driver 50 and a blade holder 30.

Figure 11:
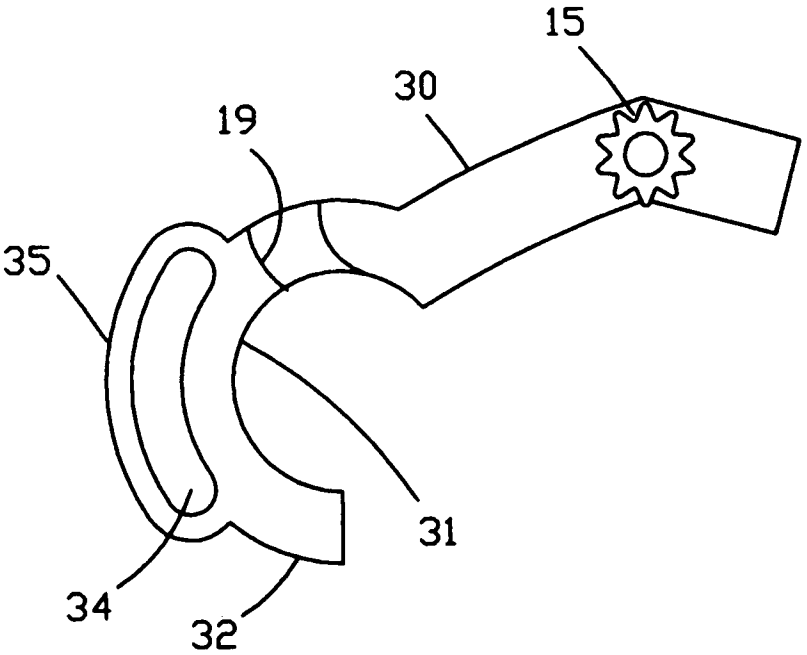
FIG. 11 is a side view of the blade holder.

As shown in FIG. 1 and FIG. 11, the blade holder 30 has an inner blade holder surface 31 and an outer blade holder surface 32. One end of the blade holder 30 is configured to attach a cutting blade 5. The inner and outer blade holder surfaces 31, 32 are partial spherical surfaces. The same end has a spur gear 15 whose teeth mesh with teeth of a spur gear track 14. The other end of the blade holder 30 is shaped as a guide 35 with slot 34. Near the middle of blade holder 30 is a curved groove 19 to accommodate the follower 39.

Figure 13:
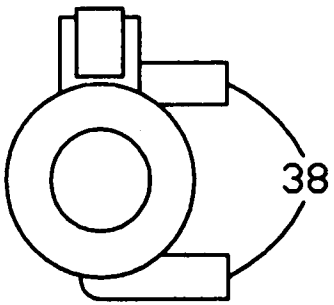
FIG. 13 is a side view of the selector.
Figure 12:
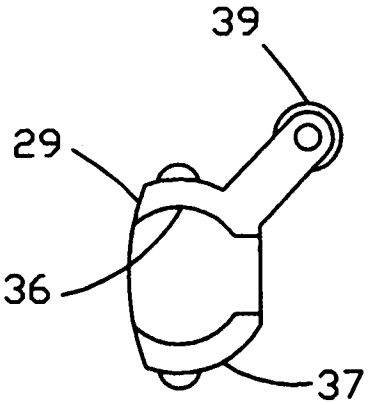
FIG. 12 is a front view of the selector.

As shown in FIG. 1 and FIGS. 12-13, the selector 29 has an inner selector surface 36 and an outer selector surface 37. The inner and outer selector surfaces 36, 37 are partial spherical surfaces. One side has a set of pins 38 to be slid in the slot 34 of the blade holder 30. The other side has a follower 39 to be slid in a curved groove 19.

Figure 10:
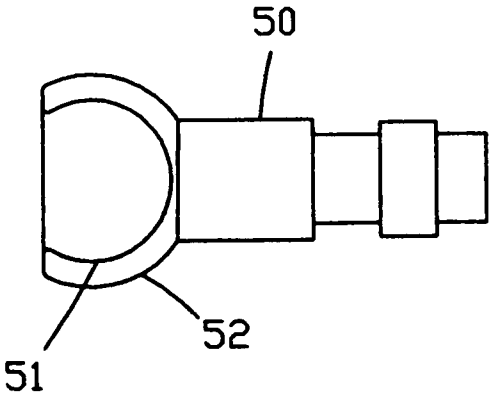
FIG. 10 is a side view of the driver.

As shown in FIG. 1 and FIG. 10, the driver 50 is in the form of a shaft. One end of the driver 50 is configured for connection to the transport wheel 3. The other end of driver 50 forms the inner driver surface 51 and the outer driver surface 52 to constitute, with the selector guide 24 and the pin 55, the partial spherical joint 60.

As shown in FIG. 1, a selector guide 24 is in the form of a shaft and protrudes from the handle 20. The selector guide 24 forms near its midpoint a partial sphere 25 that is arranged between inner selector surfaces 36 of the selector 29. The other end of the selector guide 24 has a partial spherical end 26 whose exterior surface has curvature that complements curvature of an inner driver surface 51 to form with the pin 55 the joint 60.

As shown in FIG. 1, the inner blade holder surface 31 rests on an outer driver surface 52 of the driver 50. The blade holder 30 thus tilts around the outer driver surface 52 such that the cutting blade 5 moves toward the transport wheel 3.

The cutting blade 5 is shaped as a circular blade, with surfaces 7 and 8 tapering in an end joining at cutting teeth 9. The cutting teeth 9 are equally spaced and arrayed in semicircle. A middle tooth 9*a* is located at the center of the semicircumference of cutting teeth 9. The cutting blade 5 is configured to pierce the top of a lid 77 of a can 75 with middle tooth 9*a* and/or adjacent cutting teeth 9.

The transport wheel 3 is in the form of circular blade with equally spaced teeth 2, and surface 4 that tapers toward the edge. The transport wheel is configured to engage under a rim 76 of the can 75.

Figure 3:
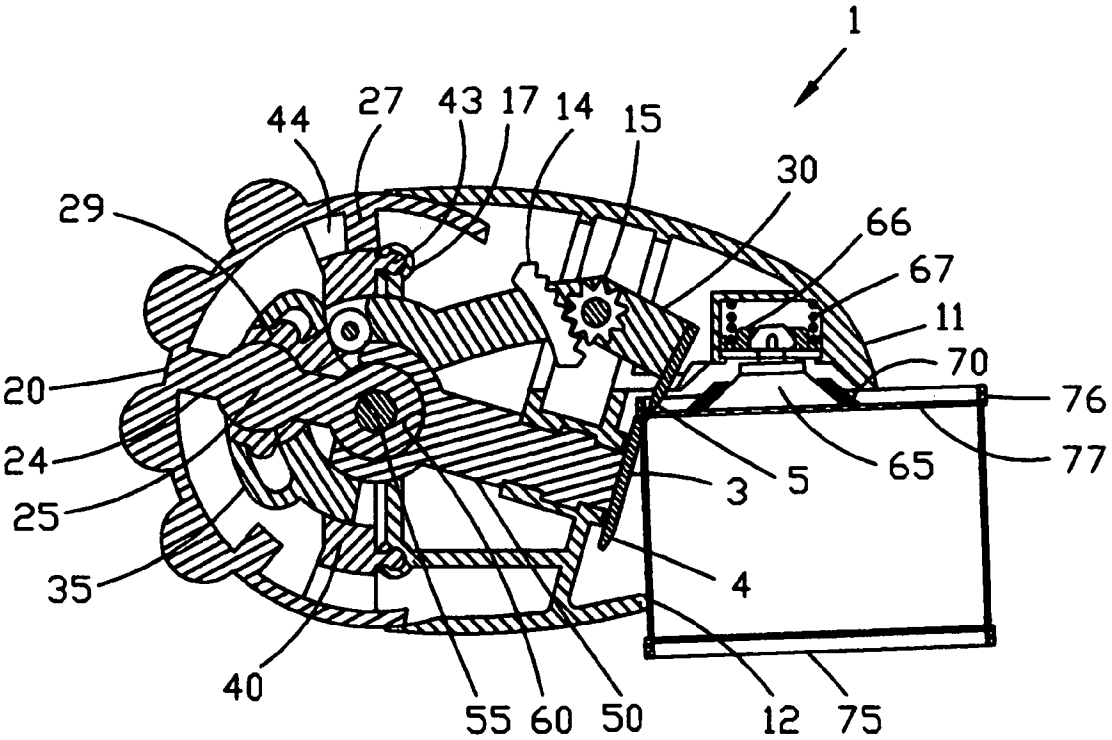
FIG. 3 is a sectional view of the can opener of FIG. 1 shown in a right handed position in which a can has been inserted.
Figure 6:
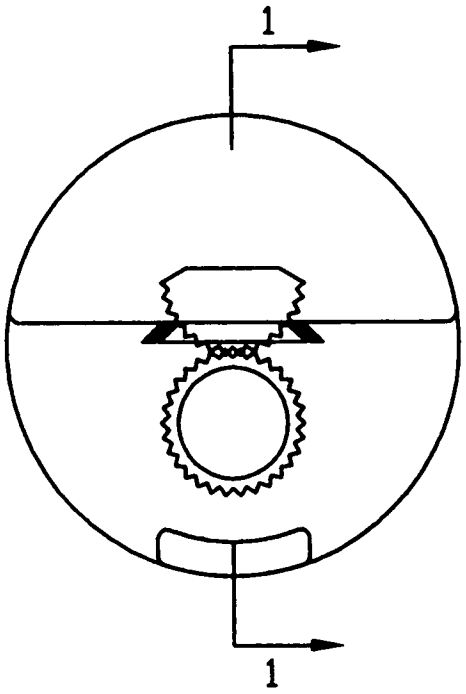
FIG. 6 is a anther front view of the can opener of FIG. 5, but with the can removed to better shown the position of the cutting blade and transport wheel of the cam.
Figure 5:
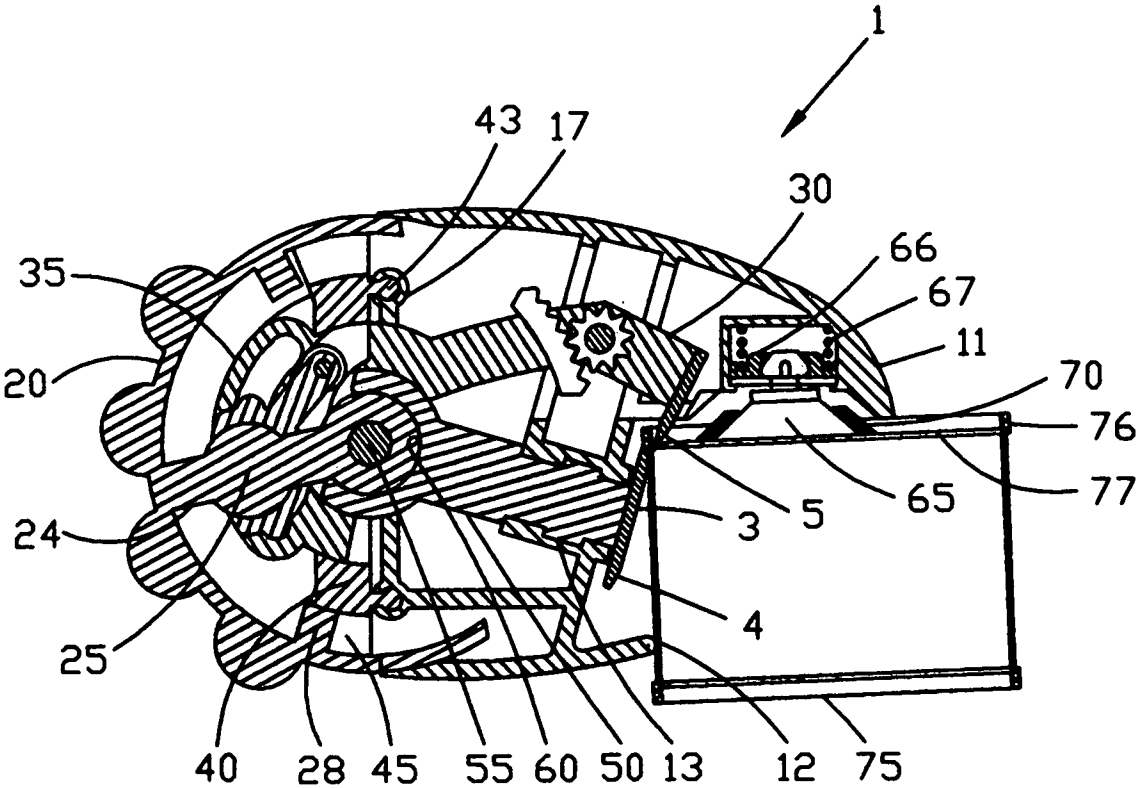
FIG. 5 is a sectional view of can opener of FIG. 1 shown in the left handed position.

As shown in FIG. 3 and FIG. 5, a can guide 12 and a hood 11 positions can 75 to be pierced or cut by cutting blade 5 during the operation of can opener 1. The hood 11 projects downward from above cutting blade 5 to a position above the lowest point of cutting blade 5. The hood 11 houses a suction cup 65, with a spring holder 66, a spring 67 and a magnet 70. The suction cup 65 is positioned to latch onto the lid 77 of the can 75 when the can is in position to be cut.

Upon insertion into the can opener 1, the lid 77 is pressed against the suction cup 65 and the magnet 70. The transport wheel 3 is also pressed against the bottom of the can rim 76, thus securing the can 75 for operation. The cutting blade 5 is then operated with transport wheel 3 to cut the lid 77 from the can 75. Suction cup 65 and/or magnet 70 holds lid 77 after the lid 77 is cut from the can 75.

As shown in FIG. 3, the can opener 1, in the right hand operation mode, and as the handle 20 tilts radially, the following occurs:

(a) the cam follower 27 slides in the groove of the inclined or helical path 44 and forms engagement of the handle 20 and the cam 40;

(b) the spur gear 15 rotates around the spur gear track 14;

(c) the selector guide 25, resting upon the inner selector surface 26, pushes up the selector 29;

(d) the selector follower 39 simultaneously slides in the curved groove 19 and tilts the blade holder 30 around the pin 55 of the partial spherical joint 60 in a direction downward to the can 75; and (e) the blade cutter 5, which is attached to the blade holder 30, contacts the can lid 77.

As the blade holder 30 is tilted further:

(f) the blade cutter 5 moves in a downward direction to pierce the top of the lid 77.

As shown in FIG. 3, the can opener 1, in the right hand operation mode and as an assembly, which is constituted by the handle 20, cam 40, selector 29, and driver 50, rotates:

(a) the cam 40 rotates in the outer blade holder surface 32 of the blade holder 30;

(b) the cam 40 rotates in the groove 43 in the flange 17 of the housing 10;

(c) the cam follower 27 slides on the side surface of the inclined or helical path 44 and creates the dragging force in the cam 40;

(d) the driver 50, as part of the partial spherical joint 60, rotates in the inner blade holder surface 31 and in the bearing 13 of the housing 10;

(e) the selector guide 25 rotates in the inner selector surface 36 of the selector 29;

(f) the follower 39 of the selector 29 slides in the curved groove 19 of the blade holder 30;

(g) the pins 38 slide in the slot 34 of the blade holder 30;

(h) the transport wheel 3, which is attached to driver 50, rotates around under the rim 76 of the can 75;

(i) the cutting blade 5 cuts the lid 65 until completing a full circle.

During the cutting process of the can 75, the position of the cutting blade 5 is maintained by the constant dragging force from the cam 40 that is exerted on the curved bulge 25 by rotation in the inner selector surface 36 of the selector 29. Upon completion of the cutting the cutting blade 5 disengages from the top of the can 75 and the cut lid 77 disengages from the transport wheel 3 by rotating the handle 20 in a direction opposite to the cutting direction. The cut lid 77 is lifted by the suction cup 65 and the magnet 70.

As shown in FIG. 5, the can opener 1 in the left-hand operation mode and as the handle 20 tilts radially, the following occurs:

(a) the cam follower 28 slides in the groove of the inclined or helical path 45 and forms engagement of the handle 20 and the cam 40;

(b) the spur gear 15 rotates around the spur gear track 14;

(c) the selector guide 25, resting upon the inner selector surface 26, pushes up the selector 29;

(d) the selector follower 39 simultaneously slides in the curved groove 19 and tilts the blade holder 30 around the pin 55 of the partial spherical joint 60 in a direction downward to the can 75; and (e) the blade cutter 5, which is attached to the blade holder 30, contacts the can lid 77.

As the blade holder 30 is tilted further:

(f) the blade cutter 5 moves in a downward direction to pierce the top of the lid 77; and (g) the pins 38 slide in the slot 34 of the blade holder 30.

As shown in FIG. 5, the can opener 1, in the left hand operation mode and as the assembly, which is constituted by the handle 20, cam 40, selector 29, and driver 50, rotates:

(a) the cam 40 rotates in the outer blade holder surface 32 of the blade holder 30;

(b) the cam 40 rotates in the groove 43 in the flange 17 of the housing 10;

(c) the cam follower 27 slides on the side surface of the inclined or helical path 45 and creates the dragging force in the cam 40;

(d) the driver 50, as part of the partial spherical joint 60, rotates in the inner blade holder surface 31 and in the bearing 13 of the housing 10;

(e) the selector guide 25 rotates in the inner selector surface 36 of the selector 29;

(f) the follower 39 of the selector 29 slides in the curved groove 19 of the blade holder 30;

(g) the transport wheel 3, which is attached to driver 50, rotates around under the rim 76 of the can 75;

(h) the cutting blade 5 cuts the lid 65 until completing a full circle.

During the cutting process of the can 75, the position of the cutting blade 5 is maintained by the constant dragging force from the cam 40 that is exerted on the curved bulge 25 by rotation in the inner selector surface 36 of the selector 29. Upon completion of the cutting the cutting blade 5 disengages from the top of the can 75 and the cut lid 77 disengages from the transport wheel 3 by rotating the handle 20 in a direction opposite to the cutting direction. The cut lid 77 is lifted by the suction cup 65 and the magnet 70.

It should be understood that foregoing description is only illustrative of the invention. Various alternatives and modifications can be devised by those skilled in the art without departing from the invention. Accordingly, the present invention is intended to encompass all such alternatives, modifications and variances that fall within the scope of appended claims.

What is claimed is:

1. A can opener for cutting a lid of a can, comprising:

a housing:

a driver connected to the housing and having a transport wheel at one end;

a handle;

a selector guide connected to the handle at one end and to the driver at another end;

a selector having a cam follower;

a blade holder connected to the selector at one end and to a spur gear and a cutting blade at another end;

a cam mounted for rotation with the driver and the blade holder; the selector being arranged within a curved slot in the blade holder.

2. The can opener of claim 1, wherein the cam has a right-hand inclined path and a left-hand inclined path.

3. The can opener of claim 2, wherein the handle has two cam followers configured to engage with the cam.

4. The can opener of claim 3, wherein the two cam followers and the cam are arranged so that during a right-hand operation, one of the cam followers engages the cam in a right-hand inclined path and during a left-hand operation, the other of the cam followers engages the cam in a left-hand inclined path.

5. The can opener of claim 3, further comprising:

a transport wheel; wherein the handle, the two cam followers, the driver and the transport wheel are arranged so that tilting the handle causes one of the two cam followers to move over one of the right-hand and the left-hand inclined paths and causes the driver to start to rotate in one mode and so that rotation of the driver in turn rotates the transport wheel and causes the transport wheel to engage a can rim.

6. The can opener of claim 5, wherein the handle is configured so that a further rotation of the handle causes the cutting blade to cut the lid of the can.

7. The can opener of claim 5, wherein the handle is radially tilted in one of two directions so that radially tilting the handle in one of the directions corresponds with carrying out a right-hand operation and another radially tilting the handle in another of the directions corresponds with carrying out a left-hand operation.

8. The can opener of claim 1, wherein the handle has an exterior facing surface with protrusions on the exterior facing surface of the handle, both the exterior facing surface and each of the protrusions having respective curvature that is partially spherical in shape.

9. The can opener of claim 1, wherein the handle has an interior contour with a partial spherical shape.

10. The can opener of claim 1, wherein the housing has at least one component selected from the group consisting of a hood, a flange, a spur gear track and a can guide.

11. The can opener of claim 1, wherein the housing has a cross-section with an oval shape interior contour.

12. The can opener of claim 1, further comprising:

a suction cup;

a magnet;

a spring holder; and a spring, wherein the spring holder is configured to secure the suction cup and the spring to the housing.

13. The can opener of claim 12, wherein the suction cup and the magnet are configured to latch onto a lid of a can to facilitate removal of the lid after operating of the can opener.

14. The can opener of claim 1, further comprising a transport wheel; the selector having an inner selector surface with curvature, the selector guide having a partial spherical curvature that complements the curvature of the inner selector surface, the selector being movable into a right hand operation mode and into a left hand operation mode so that:

in the right hand operation mode as the handle radially tilts up and engages the cam follower into a right-hand path of the cam and the partial spherical curvature of the selector guide pushes the selector upward, resulting in tilting the blade holder around a pin of a partial spherical joint and thus pushing an end of the blade holder downward to cause the cutting blade to contact the lid of the can and so that thereafter rotating the handle causes the driver to rotate in right-hand mode and causes the selector guide to rotate and causes the transport wheel to rotate to engage a can rim; and in the left-hand operation mode, the handle tilts radially and engages the cam follower to a left-hand path of the cam and the partial spherical curvature of the selector guide pushes the selector downward, resulting in the cam follower sliding in a curved groove of the blade holder, which results in tilting the blade holder around the pin of the partial spherical joint and tilting the spur gear around the partial spherical joint, thus pushing the end of the blade holder downward and causing the cutting blade to contact the lid of the can, so that thereafter rotating the handle causes the driver to rotate in left-hand mode and the selector guide to rotate the inner selector surface of the selector and cause the transport wheel to rotate and engage the can rim.

* * * * *